US009479876B2

(12) United States Patent
Neumeyer

(10) Patent No.: US 9,479,876 B2
(45) Date of Patent: Oct. 25, 2016

(54) PROCESSOR-READABLE MEDIUM, APPARATUS AND METHOD FOR UPDATING A HEARING AID

(71) Applicant: III Holdings 4, LLC, Wilmington, DE (US)

(72) Inventor: Frederick Charles Neumeyer, Austin, TX (US)

(73) Assignee: III HOLDINGS 4, LLC, Wilmington, DE (US)

( * ) Notice: Subject to any disclaimer, the term of this patent is extended or adjusted under 35 U.S.C. 154(b) by 0 days.

(21) Appl. No.: 13/782,710

(22) Filed: Mar. 1, 2013

(65) Prior Publication Data

US 2013/0266165 A1 Oct. 10, 2013

Related U.S. Application Data

(60) Provisional application No. 61/621,234, filed on Apr. 6, 2012.

(51) Int. Cl.
*H04R 25/00* (2006.01)

(52) U.S. Cl.
CPC ..... *H04R 25/30* (2013.01); *H04R 25/70* (2013.01); *H04R 2225/41* (2013.01)

(58) Field of Classification Search
CPC .... H04R 25/30; H04R 25/305; H04R 25/43; H04R 25/50; H04R 25/502; H04R 25/505; H04R 25/55; H04R 25/554; H04R 25/556; H04R 25/558; H04R 25/70; H04R 2225/00; H04R 2225/39; H04R 2225/41; H04R 2225/55; H04R 2225/81; H04R 25/00; H04R 2225/61
USPC ..... 381/58, 60, 312, 314, 315
See application file for complete search history.

(56) References Cited

U.S. PATENT DOCUMENTS

| | | | | |
|---|---|---|---|---|
| 7,200,237 | B2 | 4/2007 | Zhang et al. | |
| 8,077,891 | B2 | 12/2011 | Hasler et al. | |
| 8,406,442 | B2 * | 3/2013 | Ribic | 381/320 |
| 8,588,442 | B2 * | 11/2013 | Schmitt et al. | 381/314 |
| 8,965,017 | B2 | 2/2015 | Bryant et al. | |
| 2007/0098195 | A1 | 5/2007 | Holmes et al. | |
| 2009/0047994 | A1 | 2/2009 | Sommer et al. | |
| 2009/0154741 | A1 * | 6/2009 | Woods et al. | 381/312 |
| 2010/0290654 | A1 * | 11/2010 | Wiggins et al. | 381/314 |
| 2012/0183165 | A1 * | 7/2012 | Foo et al. | 381/314 |
| 2012/0213393 | A1 | 8/2012 | Foo et al. | |
| 2012/0219159 | A1 * | 8/2012 | Burk et al. | 381/60 |
| 2015/0156596 | A1 | 6/2015 | Bryant et al. | |

OTHER PUBLICATIONS

United States Patent and Trademark Office, Non-Final Office Action, U.S. Appl. No. 14/611,944, mailed May 17, 2016, 19 pages.
United States Patent and Trademark Office, Non-Final Office Action, U.S. Appl. No. 13/723,667, mailed Mar. 13, 2014, 14 pages.
United States Patent and Trademark Office, Notice of Allowance, U.S. Appl. No. 13/723,667, mailed Oct. 17, 2014, 7 pages.

* cited by examiner

*Primary Examiner* — Paul S Kim
*Assistant Examiner* — Sabrina Diaz
(74) *Attorney, Agent, or Firm* — Perkins Coie LLP

(57) ABSTRACT

A system for updating a hearing aid by providing an update to a hearing aid to configure the hearing aid for an acoustic environment with a sound profile different than a physical environment a user is currently located in with an acoustic sample representative of the acoustic environment.

12 Claims, 3 Drawing Sheets

PROCESSOR-READABLE MEDIUM, APPARATUS AND METHOD FOR UPDATING A HEARING AID

CROSS-REFERENCE TO RELATED APPLICATION(S)

This application is a nonprovisional application of and claims priority to Provisional Application No. 61/621,234 filed on Apr. 6, 2012 and entitled "PROCESSOR-READABLE MEDIUM, APPARATUS AND METHOD FOR UPDATING A HEARING AID," which is incorporated herein by reference in its entirety.

FIELD

This disclosure relates generally to hearing aids, and more particularly to hearing aids that are user adjustable.

BACKGROUND

Hearing deficiencies can range from partial hearing impairment to complete hearing loss. Often, an individual's hearing ability varies across the range of audible sound frequencies, and many individuals have hearing impairment with respect to only select acoustic frequencies. For example, an individual's hearing loss may be greater at higher frequencies than at lower frequencies.

A hearing health professional typically takes measurements using calibrated and specialized equipment to assess an individual's hearing capabilities in a variety of sound environments, and then adjusts the hearing aid based on the calibrated measurements. Subsequent adjustments to the hearing aid can require a second exam and further calibration by the hearing health professional, which can be costly and time intensive. In some instances, the hearing health professional may create multiple hearing profiles for the user for use in different sound environments.

However, merely providing stored hearing profiles to the user often leaves the user with a subpar hearing experience because each acoustic environment may vary in some way from the stored hearing aid profiles provided by the hearing health professional. Simply, storing more profiles on the hearing aid provides for better coverage of environmental systems but requires larger memories and increases the processing requirements in the hearing aid. Increased memory and enhanced processing increase the size requirements of the hearing aid that users want to be small and unobtrusive.

Some hearing aid systems allow the user to adjust their hearing aid after an initial programming by a hearing health professional by connecting the hearing aids to their personal computer (PC) and allowing the user to adjust the hearing aids while in use so that the user can hear the differences between each adjustment. However, while these hearing aid to PC systems allow for easier adjustments it is very difficult for a user to take into consideration acoustic environmental changes when adjusting a hearing aid because the home acoustic environment may be externally different form the intended use acoustic environment.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of systems, hearing aids, computing devices, and methods are described below that allow for environmental simulation during programming of a hearing aid profile (sound-shaping profile) of a hearing aid. In an example, the hearing aid and the computing device communicate through a radio frequency communication channel, wirelessly, to exchange profile data and/or acoustic samples that can be used by one or both devices to simulate the experience of utilizing a hearing aid profile in an acoustic environment represented by the acoustic sample. The computing device can be any electronic device including a processor, a memory, and a transceiver for communicating data to a hearing aid through a wireless (radio frequency) communication channel.

Figure 1:
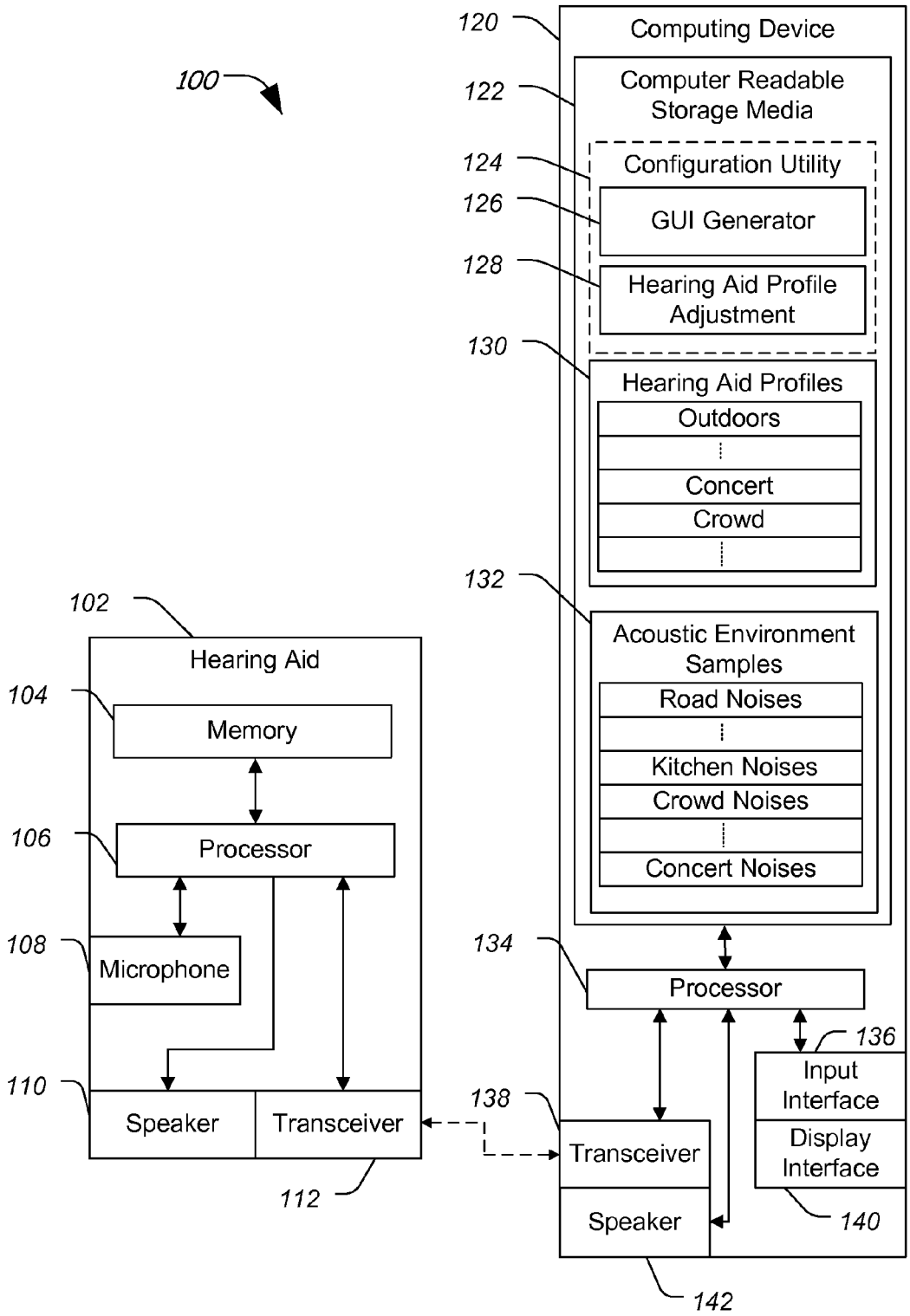
FIG. 1 is a block diagram of an embodiment of a hearing aid and a computing device adapted to provide user adjustment and acoustic environment simulation.

FIG. 1 is a block diagram of an embodiment of a hearing aid 102 and a computing device 120 adapted to provide user adjustment and acoustic environment simulation. Hearing aid 102 includes a transceiver 112 that is configured to communicate with computing device 120 through a communication channel. In some instances, the wireless communication channel can be a Bluetooth® communication channel. Hearing aid 102 also includes and microphone 108 to receive environmental noise or sounds and to convert the sounds into an audio signal and processor 106 for shaping an audio signal according to a hearing aid profile to produce a modified audio signal. Processor 106 is coupled to a speaker 110, which is configured to reproduce the modified audio signal as an audible sound at or within an ear canal of the user.

Computing device 120 is a personal digital assistant (PDA), smart phone, portable computer, or other computing device adapted to send and receive radio frequency signals according to any protocol compatible with hearing aid 102. One representative embodiment of computing device 120 includes the Apple iPhone®, which is commercially available from Apple, Inc. of Cupertino, Calif. or Blackberry®, available from Research In Motion Limited of Waterloo, Ontario. Other types of mobile telephone devices with short range wireless capability can also be used.

Computing device 120 includes computer-readable storage media 122, which is accessible by a processor 134. Computing device 120 further includes a transceiver 138, which is coupled to processor 134, such that processor 134 may send and receive data packets to and from transceiver 112 through transceiver 138. Computing device 120 also includes a display interface 140 and an input interface 136 to display information to a user and to receive user input, respectively. In some embodiments, a touch screen display may be used, in which case display interface 140 and input interface 136 are combined into a user interface.

Computer-readable storage media 122 stores a plurality of instructions that are executable by processor 134, including a configuration utility 124 with graphical user interface (GUI) generator instructions 126 and hearing aid profile adjustment instructions 128, a plurality of hearing aid profiles 130, and a plurality of acoustic environment samples 132. The acoustic environment samples are a collection of sounds representative of specific acoustic environments, such as a busy road, a park, a concert or other acoustic environment. Depending on the configuration of the computing device 120, the one or more computer-readable storage media 122 may be an example of non-transitory computer storage media and may include volatile and non-volatile memory and/or removable and non-removable media implemented in any type of technology for storage of information such as computer-readable instructions, data structures, program modules or other data. Such computer-readable media includes, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processor 134 directly or through another computing device. Accordingly, the computer-readable storage media 122 may be computer-readable media able to maintain instructions, modules or components executable by the processor 134.

Additionally, computing device 120 includes speaker 142 for reproducing the acoustic environment samples as audible sound. In some instances, such as where computing device 120 is a portable computer, speaker 142 may be external to computing device 120 and coupled to an audio output interface of computing device 120.

The term "hearing aid profile" refers to a collection of acoustic configuration settings for hearing aid 102, which are used by processor 106 within hearing aid 102 to shape acoustic signals. Each of the hearing aid profiles of the plurality of hearing aid profiles 130 are based on the user's hearing characteristics and designed to compensate for the user's hearing loss or otherwise shape the sound received by microphone 108. Each hearing aid profile includes one or more parameters to shape or otherwise adjust sound signals for a particular acoustic environment. In particular, the one or more parameters are configurable to customize the sound shaping and to adjust the response characteristics of hearing aid 102, so that processor 106 can apply a customized hearing aid profile to a sound-related signal to compensate for hearing deficits of the user or otherwise enhance the sound-related signals. Such parameters can include signal amplitude and gain characteristics, signal processing algorithms, frequency response characteristics, coefficients associated with one or more signal processing algorithms, or any combination thereof.

In an embodiment, a user initiates a hearing aid profile configuration process by launching an application on computing device 120, which triggers configuration utility 124. Configuration utility 124 causes processor 134 to execute hearing aid profile adjustment instructions 128 and GUI generator instructions 126. GUI generating instructions 128 when executed cause processor 124 to display a user interface on display interface 140 and wait for user selections from input interface 136.

In one example, the user interface provides the user with a list representative of the plurality of hearing aid profiles 130, which the user may select to adjust. The user interface also provides a second representative list comprising the acoustic environment samples 132 for the user to select from while adjusting the selected hearing aid profile. Once the user selects a hearing aid profile from the representative list, hearing aid adjustment instructions 128 allow the user to make modifications to the sound shaping instruction included within the selected hearing aid profile to generate a modified hearing aid profile. In another example, the user may select to generate a new hearing aid profile and may utilize hearing aid adjustment instructions 128 to generate a hearing aid profile from scratch or from the stored values representative of their hearing loss.

Once a modified hearing aid profile has been generated and an acoustic environment samples has been selected, processor 134 provides the modified hearing aid profile to hearing aid 102 through the communication channel and the selected acoustic environment to speaker 142 for reproduction as audible sound. In this manner, the user is able to determine if the modified hearing aid profile is suitable to the acoustic environment represented by the acoustic environment sample without being in the actual acoustic environment. Thus the user may generate hearing aid profiles for specific acoustic environments in the comfort of their own home.

In an example, processor 134 may alternatively provide hearing aid 102 with the modified hearing aid profile and the original hearing aid profile in an iterative manner, while speaker 142 is reproducing the acoustic environment sample as sound, such that the user may hear the difference between the original and the modified profile.

In another example, once the acoustic environment sample is selected computing device 120 may begin to reproduce the sample as audible sound during the adjustment process and processor 134 may provide the adjustments to the selected hearing aid profile to hearing aid 102 in real time, such that the user may make an adjustment and then hear how the adjustment changed the sound shaping of the hearing aid profile as the user makes each individual adjustment.

It should also be understood, that multiple acoustic environment samples may be played simultaneously to provide an acoustic environment including two or more environments. For example, an acoustic sample of road noise may be played with an acoustic sample of a crowd to simulate a street full of automobiles and pedestrians.

In another embodiment once the modified hearing aid profile is generated, processor 134 applies both the modified hearing aid profile to the acoustic sample to generate a first adjusted acoustic sample and the original hearing aid profile to the acoustic sample to generate a second adjusted acoustic sample. The first and second adjusted acoustic samples are then provided to either speaker 142 or to hearing aid 102 for reproduction as audible sound without the need for further modification.

In yet another embodiment once the modified hearing aid profile is generated, both the modified hearing aid profile and the original hearing aid profile together with the selected acoustic environment are provided to hearing aid 102. Processor 106 of hearing aid 102 applies both the modified hearing aid profile and the original hearing aid profile to the selected acoustic environment to produce a first and second modified acoustic sample respectively. The first and second modified acoustic samples are provided iteratively to speaker 110 for reproduction as audible sound.

Figure 2:
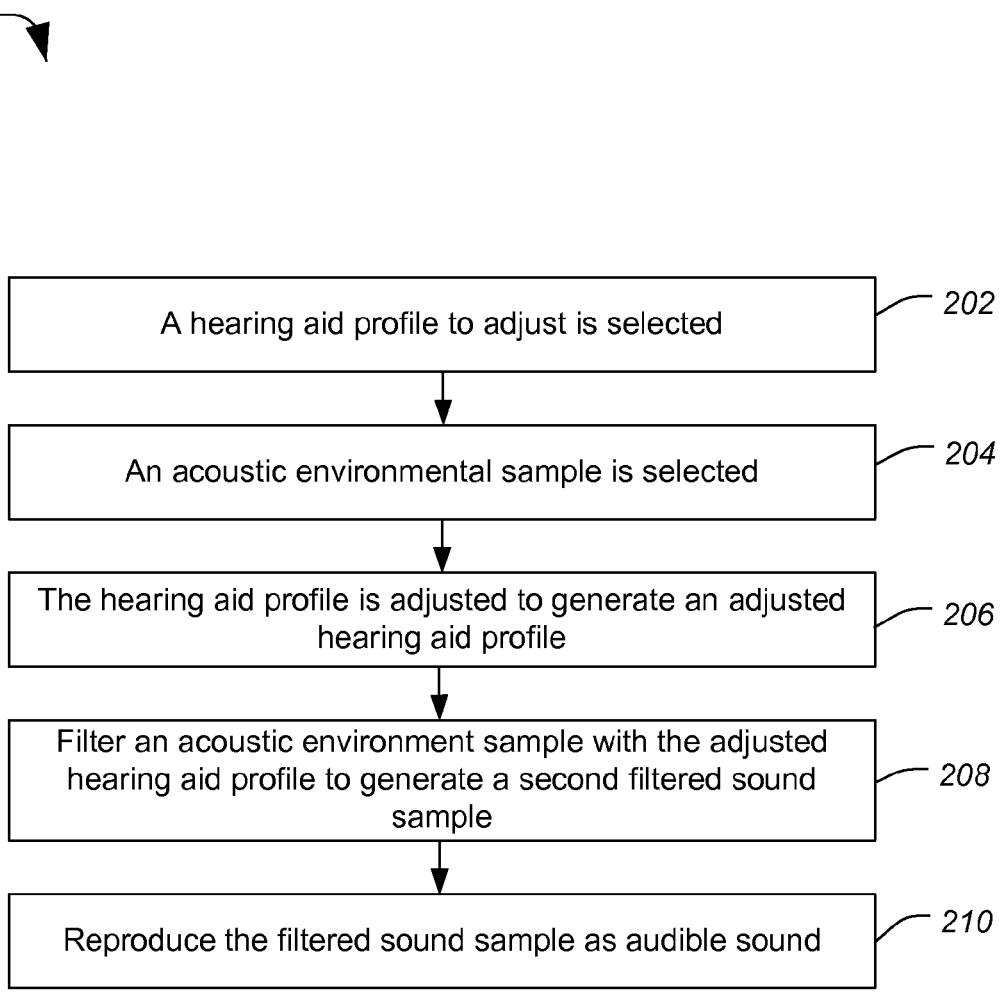
FIG. 2 is a flow diagram of the computing device of FIG. 1 that provides hearing aid profile adjustment and acoustic environment simulation.

FIG. 2 is a process flow diagram 200 of computing device 120 that provides hearing aid profile adjustment and acoustic environment simulation. At 202, a hearing aid profile to adjust is selected at computing device 120. Proceeding to 204, an acoustic environmental sample is selected at computing device 120 from the plurality of acoustic environmental samples 132.

Advancing to 206, the hearing aid profile is adjusted to generate an adjusted hearing aid profile. The hearing aid profile may be adjusted by the user via input interface 136 and display interface 140 or adjusted automatically by processor 134 executing hearing aid profile adjustment instructions 128. For example, hearing aid profile adjustment instruction 128 may cause processor 134 to apply the hearing aid profile to the acoustic environmental sample until the resulting sample's sound characteristics are within a predetermined threshold. In another example, hearing aid profile adjustment instruction 128 may cause processor 134 to determine sound characteristics of the acoustic environmental sample and by analyzing the user's hearing loss characteristics and the sound characteristics generating a suitable hearing aid profile.

Once the adjusted hearing aid profile is generated, method 200 proceeds to 208 and the acoustic environment sample is filtered with the adjusted hearing aid profile to generate a filtered sound sample. In one example, processor 134 of computing device 120 applies the adjusted hearing aid to the acoustic environmental sample to generate the filtered sound sample. In another example, the adjusted hearing aid profile and the acoustic environmental sample may be provided to hearing aid 102 and processor 106 applies the adjusted hearing aid profile to the acoustic environmental sample to generate the filtered sound sample. Proceeding to 212, the filtered sound sample is reproduced as audible sound, such that the user can determine what the adjusted hearing aid profile would sound like in the adjusted hearing aid profile's intended acoustic environment.

In an alternative method, the acoustic environment sample may also filtered with the hearing aid profile to generate a second filtered sound sample, which may be reproduced for the user in an alternating manner with the filtered sound sample. In this manner the user is able to determine the differences in operation between the hearing aid profile and the adjusted hearing aid profile as if the user was in the intended acoustic environment.

Figure 3:
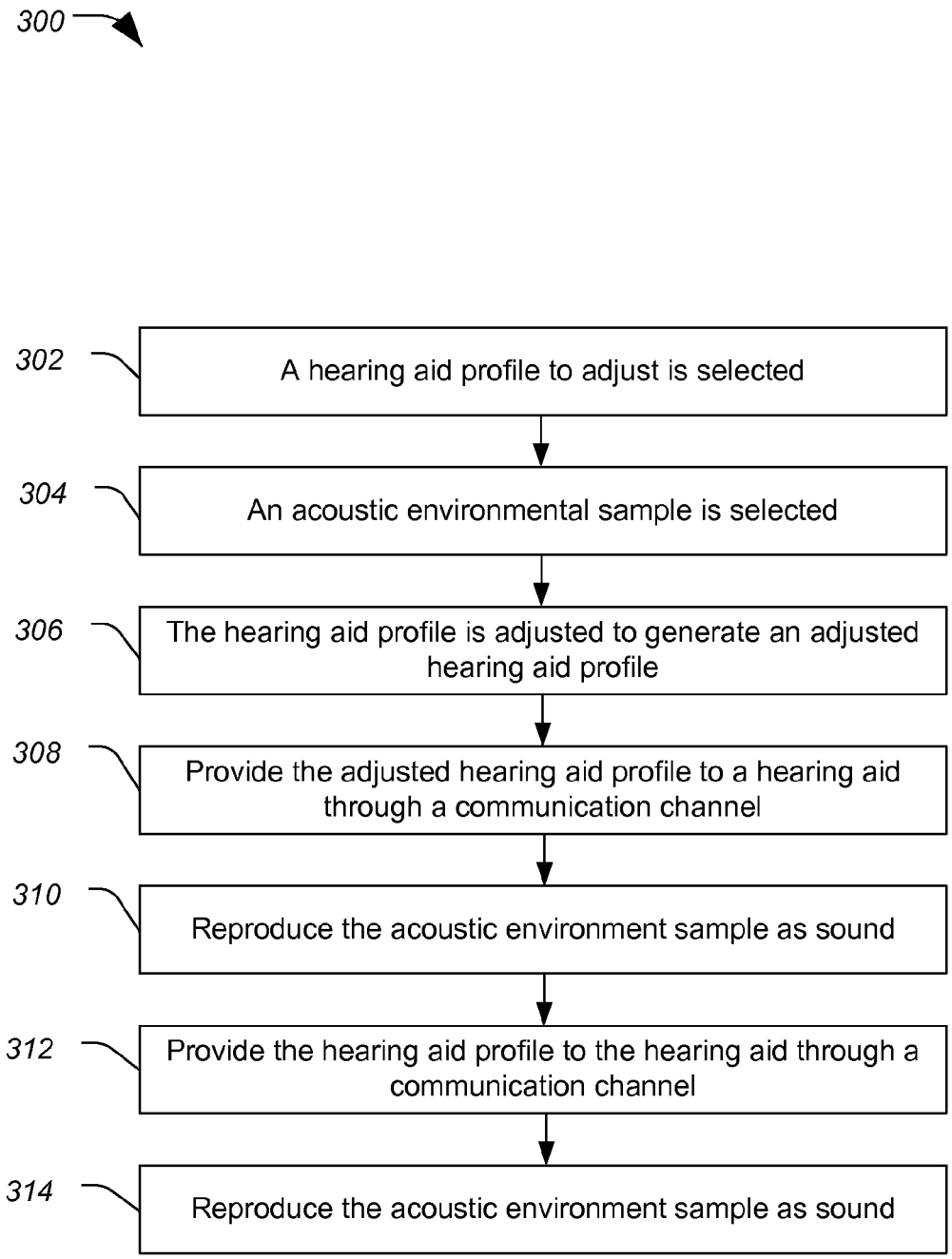
FIG. 3 is a second flow diagram of the computing device of FIG. 1 that provides hearing aid profile adjustment and acoustic environment simulation.

FIG. 3 is a second flow diagram 300 of computing device 120 that provides hearing aid profile adjustment and acoustic environment simulation. At 302, a hearing aid profile to adjust is selected at computing device 120. Proceeding to 304, an acoustic environmental sample is selected at computing device 120 from the plurality of acoustic environmental samples 132. Advancing to 306, the hearing aid profile is adjusted to generate an adjusted hearing aid profile.

Proceeding to 308, computing device 120 provides the adjusted hearing aid profile to hearing aid 102 through the communication channel. Hearing aid 102 is programmed to filter sound with the hearing aid profile provided by computing device 120, in this case the adjusted hearing aid profile. Moving to 310, computing device 120 reproduces the acoustic environmental sample as sound via speaker 142. Thus method 300 allows the user to simulate the acoustic environment represented by the acoustic environment sample in a realistic way. Method 300 does so by allowing hearing aid 102 to detect the sound (the reproduced acoustic environmental sample) at microphone 108 convert the sound to an audio signal (electrical signals) and processor 108 filtering the audio signal as dictated by the adjusted hearing aid profile to generate a filtered audio signal. The filtered audio signal is then provided to speaker 110 for reproduction as audible sound at the user's ear. By filtering the sound at hearing aid 102 and producing the sound at computing device 120, hearing aid 102 is able to filter sound as if the user was actually in the acoustic environment represented by the acoustic environmental sample.

In some cases method 300 continues to 312 and computing device 120 provides the hearing aid profile to hearing aid 102 through the communication channel, such that hearing aid 102 filters sounds using the original hearing aid profile instead of the adjusted hearing aid profile. Advancing to 314, computing device 120 reproduces the acoustic environment sample as sound once again, such that the user can compare the adjusted hearing aid profile with the original hearing aid profile. Method 300 may continue to alternate between providing the adjusted hearing aid profile and the original hearing aid profile to hearing aid 102 until computing device 120 receives a signal to stop. It should also be understood that as computing device 120 alternatively provides the adjusted hearing aid profile and the original hearing aid profile to hearing aid 102, computing device 120 may continuously reproduce the acoustic environmental sample as sound nonstop.

Although the present invention has been described with reference to preferred embodiments, workers skilled in the art will recognize that changes may be made in form and detail without departing from the scope of the invention.

What is claimed is:

1. One or more non-transitory computer-readable storage media storing instructions, which, when executed by one or more processors, cause the one or more processors to:

receive a first user input from a computing device, wherein the first user input is indicative of a selection of a first hearing aid profile, and wherein the selected hearing aid profile corresponds to an acoustic environment of a first physical environment;

output a sound sample representative of the acoustic environment of the first physical environment from the computing device in a second, different physical environment;

receive a second user input from the computing device, wherein the second user input includes at least one adjusted parameter of the selected hearing aid profile;

generate an updated hearing aid profile including the at least one adjusted parameter;

provide the updated hearing aid profile to a hearing aid through a communication channel;

apply the updated hearing aid profile to the sound sample to generate an adjusted sound sample representative of the acoustic environment of the first physical environment; and output the adjusted sound sample representative of the acoustic environment of the first physical environment from the computing device in the second physical environment.

2. The one or more non-transitory computer-readable storage media of claim 1 wherein the instructions, when executed by one or more processors, further cause the one or more processors to provide updated hearing aid profile to the hearing aid via a radio frequency transceiver.

3. The one or more non-transitory computer-readable storage media of claim 1 wherein the instructions, when executed by one or more processors, further cause the one or more processors to:

capture the sound sample during a first period of time; and output the sound sample during a second period of time.

4. The one or more non-transitory computer-readable storage media of claim 1 wherein the instructions, when executed by one or more processors, further cause the one or more processors to:

provide a graphical user interface including a plurality of adjustment elements to a display;

receive user input corresponding to at least one of the plurality of adjustable elements of the graphical user interface from an input interface; and adjust the selected hearing aid profile according to the received user input to generate the updated hearing aid profile.

5. The one or more non-transitory computer-readable storage media of claim 1 wherein the instructions, when executed by one or more processors, further cause the one or more processors to provide the sound sample to a remote speaker for reproduction as audible sound.

6. The one or more non-transitory computer-readable storage media of claim 1 wherein the instructions, when executed by one or more processors, further cause the one or more processors to provide the sound sample to the hearing aid for reproduction as audible sound.

7. The one or more non-transitory computer-readable storage media of claim 1 wherein the instructions, when executed by one or more processors, further cause the one or more processors to create a new hearing aid profile including the at least one adjusted parameter.

8. An apparatus comprising:

a transceiver configured to communicate with a hearing aid;

a user interface configured to receive instructions from a user;

a transducer configured to output sound, wherein the transducer is positioned in a first acoustic environment;

a processor coupled to the transceiver; and a memory accessible to the processor, wherein the memory is configured to store a plurality of instructions, that, when executed by the processor, cause the processor to:

receive a first user input from the user interface indicative of a selection of a hearing aid profile, wherein the selected hearing aid profile corresponds to a second acoustic environment different from the first acoustic environment;

output a sound sample representative of the second acoustic environment to the transducer in response to the first user input;

receive a second user input from the user interface to adjust at least one parameter of the selected hearing aid profile;

generate an updated hearing aid profile including the at least one adjusted parameter in response to the second input;

transmit the updated hearing aid profile via the transceiver to the hearing aid while outputting the sound sample via the transducer;

apply the updated hearing aid profile to the sound sample to generate an adjusted sound sample representative of the second acoustic environment; and output the adjusted sound sample to the transducer.

9. The apparatus of claim 8 wherein the instructions, when executed by the processor, further cause the processor to alternately provide the selected hearing aid profile and the updated hearing aid profile to the hearing aid in a repeating pattern while outputting the sound representative of an acoustic environment.

10. The apparatus of claim 8 wherein the instructions, when executed by the processor, further cause the processor to output acoustic samples stored in the memory while outputting the sound sample.

11. The apparatus of claim 8 wherein the user interface includes a graphical user interface having a plurality of adjustment elements and at least one user-selectable option corresponding to a plurality of hearing aid profiles on a display device coupled to the processor.

12. The apparatus of claim 8 wherein the instructions, when executed by the processor, further cause the processor to generate a new hearing aid profile based in part on a hearing loss profile and the second user input.

* * * * *